US011905642B2

(12) United States Patent
Lee et al.

(10) Patent No.: US 11,905,642 B2
(45) Date of Patent: Feb. 20, 2024

(54) LAUNDRY TREATMENT APPARATUS

(71) Applicant: LG Electronics Inc., Seoul (KR)

(72) Inventors: Youngjoo Lee, Seoul (KR); Sangwook Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 66 days.

(21) Appl. No.: 17/492,266

(22) Filed: Oct. 1, 2021

(65) Prior Publication Data

US 2022/0018054 A1 Jan. 20, 2022

Related U.S. Application Data

(63) Continuation of application No. 16/537,156, filed on Aug. 9, 2019, now Pat. No. 11,155,956.

(30) Foreign Application Priority Data

Aug. 9, 2018 (KR) ..... 10-2018-0093385

(51) Int. Cl.
*D06F 39/04* (2006.01)
*D06F 58/26* (2006.01)
(Continued)

(52) U.S. Cl.
CPC ..... *D06F 39/04* (2013.01); *D06F 34/24* (2020.02); *D06F 58/04* (2013.01); *D06F 58/206* (2013.01);
(Continued)

(58) Field of Classification Search
CPC ..... D06F 39/04; D06F 34/24; D06F 58/04; D06F 58/206; D06F 58/26; D06F 58/03;
(Continued)

(56) References Cited

U.S. PATENT DOCUMENTS 5,266,764 A 11/1993 Fox et al.
5,724,750 A * 3/1998 Burress ..... D06F 58/26 34/267
(Continued)

FOREIGN PATENT DOCUMENTS

CN 1782209 6/2006
CN 1782210 6/2006
(Continued)

OTHER PUBLICATIONS

CN Office Action in Chinese Appln. No. 201910734759.5, dated Apr. 2, 2021, 12 pages (with English translation).
(Continued)

*Primary Examiner* — John P McCormack
(74) *Attorney, Agent, or Firm* — Fish & Richardson P.C.

(57) ABSTRACT

A laundry treatment apparatus is disclosed. The laundry treatment apparatus includes a cabinet, a tub arranged in the cabinet, a drum arranged in the tub and formed of a metal material, and an induction module configured to inductively heat the drum, wherein the induction module includes a coil formed by winding a wire, and a base housing including a base body arranged on the tub, and a fixing rib arranged on the base body to fix the coil, wherein the wire is drawn into the base body in one direction, wound around the fixing rib, and drawn out of the base body in the same direction.

21 Claims, 10 Drawing Sheets

(51) Int. Cl.

| | |
|---|---|
| ***D06F 58/30*** | (2020.01) |
| ***D06F 34/24*** | (2020.01) |
| ***D06F 58/04*** | (2006.01) |
| ***D06F 58/20*** | (2006.01) |
| *D06F 105/28* | (2020.01) |

(52) U.S. Cl.
CPC ..... *D06F 58/26* (2013.01); *D06F 58/30* (2020.02); *D06F 2105/28* (2020.02)

(58) Field of Classification Search
CPC .... D06F 2105/28; D06F 37/20; D06F 37/264; D06F 37/267; H05B 6/102; H05B 6/36; H05B 6/365; H05B 6/101; H05B 2206/022
USPC ..... 34/595
See application file for complete search history.

(56) References Cited

U.S. PATENT DOCUMENTS

| | | | | |
|---|---|---|---|---|
| 6,084,225 | A | 7/2000 | Schmitt | |
| 9,153,899 | B2 | 10/2015 | Morello et al. | |
| 2011/0041260 | A1 | 2/2011 | Balinski et al. | |
| 2015/0099384 | A1 | 4/2015 | Morello et al. | |
| 2015/0108287 | A1 | 4/2015 | Arai et al. | |
| 2016/0366726 | A1* | 12/2016 | Lomp | H05B 6/44 |
| 2017/0254015 | A1 | 9/2017 | Duckworth | |
| 2018/0057996 | A1 | 3/2018 | Park et al. | |
| 2018/0148886 | A1 | 5/2018 | Kalze et al. | |
| 2019/0186265 | A1 | 6/2019 | Friedman et al. | |
| 2019/0330792 | A1* | 10/2019 | Del Maschio | D06F 34/18 |
| 2019/0352838 | A1* | 11/2019 | Lim | D06F 58/26 |

FOREIGN PATENT DOCUMENTS

| | | | | |
|---|---|---|---|---|
| CN | 201722528 | | 1/2011 | |
| CN | 102191675 | | 9/2011 | |
| CN | 202030957 | | 11/2011 | |
| CN | 202421980 | | 9/2012 | |
| CN | 206024149 | | 3/2017 | |
| CN | 206650864 | | 11/2017 | |
| CN | 107426845 | * | 12/2017 | |
| CN | 107780163 | | 3/2018 | |
| CN | 20751888 | | 6/2018 | |
| DE | 102010017103 | | 2/2011 | |
| DE | 202004021906 | * | 6/2012 | |
| DE | 102016122744 | | 5/2018 | |
| EP | 2400052 | | 12/2011 | |
| EP | 2400052 | A1 * | 12/2011 | D06F 37/26 |
| EP | 2100996 | | 2/2016 | |
| EP | 3287558 | | 2/2018 | |
| JP | 3861731 | | 12/2006 | |
| KR | 2019860003312 | | 11/1986 | |
| KR | 10-2005-0101816 | | 10/2005 | |
| WO | WO2018038580 | | 3/2018 | |

OTHER PUBLICATIONS

Extended European Search Report in European Application No. 19190497.8, dated Oct. 29, 2019, 8 pages.

PCT International Search Report and Written Opinion in International Application No. PCT/KR2019/009805, dated Nov. 8, 2019, 11 pages.

Office Action in Chinese Appln. No. 202210670060.9, dated Aug. 7, 2023, 18 pages (with English translation).

* cited by examiner

LAUNDRY TREATMENT APPARATUS

CROSS-REFERENCE TO RELATED APPLICATIONS

This application is a continuation of U.S. application Ser. No. 16/537,156, filed on Aug. 9, 2019, which claims the benefit of Korean Patent Application No. 10-2018-0093385, filed on Aug. 9, 2018. The disclosures of the prior applications are incorporated by reference in their entirety.

TECHNICAL FIELD

The present invention relates to a laundry treatment apparatus.

BACKGROUND

Electric heaters, gas heaters, heat pumps, and the like are known as heating means for conventional laundry treatment apparatuses. Recently, laundry treatment apparatuses using induction heating as new heating means have been developed.

In the induction heating technique, the circumferential surface of the drum is basically heated through a magnetic field generated by applying a current to a coil formed by winding of a wire. The drum is rotated when a current is applied to ensure that the drum is uniformly heated.

Generally, the coil is fixed to a part of a tub adjacent to the circumferential surface of the drum. In order for the coil to be securely fixed to the tub, a structure to be mounted on the tub to accommodate the coil is needed.

However, as the drum rotates in various operations such as washing, drying, or refreshing, vibration may be transmitted to the tub, thereby causing the coil to be lifted or even dislodged from the structure in a severe case.

In addition, there may be a vibration phase difference between the structure and the controller connected to both ends of the coil. The vibration phase difference may cause the structure to produce continuous friction on the coil surface and, leading to fatigue failure, which raises an issue of disconnection.

SUMMARY

Accordingly, the present invention is directed to a laundry treatment apparatus that substantially obviates one or more problems due to limitations and disadvantages of the related art.

An object of the present invention is to provide a laundry treatment apparatus in which a coil for induction heating is securely fixed to a tub.

Another object of the present invention is to prevent damage to a coil for induction heating, and more particularly, to connect, to a controller, a wire forming a coil fixed to a tub through a portion of the outer circumferential surface of the tub that vibrates least.

Another object of the present invention is to minimize the length of a wire forming a coil for induction heating.

Another object of the present invention is to provide a laundry treatment apparatus capable of reducing resistance at a lead wire for forming a coil and securely fixing the lead wire.

Another object of the present invention is to provide a laundry treatment apparatus capable of substantially increasing the number of turns of a coil and increasing the area of the coil through the drawing structure and the fixing structure of two lead wires to improve efficiency.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry treatment apparatus includes a cabinet, a tub arranged in the cabinet, a drum arranged in the tub and formed of a metal material, and an induction module configured to inductively heat the drum, wherein the induction module includes a coil formed by winding a wire, and a base housing including a base body arranged on the tub, and a fixing rib arranged on the base body to fix coil, wherein the wire is drawn into the base body in one direction, wound around the fixing rib, and drawn out of the base body in the same direction.

The wire forming the coil in the base housing has two lead wires. Alternating current flows through the coil via the two lead wires.

Accordingly, a wire portion that extends further from both ends of the wound wire and is connected to a power terminal may be referred to as a lead wire.

The two lead wires may be drawn in the same direction with respect to the induction module. This configuration may minimize the spacing between the two lead wires and allow the two lead wires to be easily bound into a bundle and connected to the power terminal.

Accordingly, the drawing direction of the two lead wires may correspond to a side adjacent to the power terminal. For example, when the power terminal is located behind the induction module, the two lead wires may be drawn to the rear of the induction module.

In exemplary embodiments, the laundry treatment apparatus may further include a controller connected to the wire and configured to regulate electrical current supplied to the coil, wherein the controller may be fixed to an inside of the cabinet and be arranged on a rear side of the cabinet. Therefore, the two lead wires may be drawn out toward the rear side of the cabinet to facilitate connection between the power terminal provided to the controller and the two lead wires.

When the wire is wound to form a coil, the winding begins on a radially outer side and ends on a radially inner side. Accordingly, a lead wire arranged at the radially outermost side and a lead wire arranged at the radially innermost side are provided.

Here, the position of the lead wire extending from the radially innermost side to the outside of the induction coil is very important. This is because the lead wire extending from the radially innermost side of the coil needs to be prevented from interfering with the coil and also needs to be reliably fixed. In addition, the position of the lead wire extending from the radially outermost side to the outside of the induction coil is also very important. This is because the lead wire needs to be reliably fixed.

In exemplary embodiments, the base housing may further include a penetrated portion provided in the base body to allow the wire to vertically pass therethrough. In exemplary embodiments, the penetrated portion may include a first penetrated portion arranged on or outside an outermost portion of the fixing rib.

In exemplary embodiments, the first penetrated portion may be disposed on a left or right side of the base body.

In exemplary embodiments, the fixing rib may be arranged on a top surface of the base body, wherein the wire may pass through the first penetrated portion via a space under the base body and be wound around the fixing rib.

In exemplary embodiments, the first penetrated portion may include a first inner wall defining a first through hole, and a first lower inclined surface connecting a bottom surface of the base body and a lower end of the first inner wall, and a first upper inclined surface connecting an upper end of the first inner wall and a top surface of the base body.

Herein, the first penetrated portion is provided to allow a lead wire (hereinafter referred to as an "outer lead wire") drawn out of the radially outermost side of the coil to pass therethrough. Of course, the outer lead wire may not extend to the lower portion of the base housing through the first penetrated portion.

However, in this case, the outer lead wire may be displaced to the upper portion of the base housing, and therefore a separate structure for preventing the lead wire from being displaced to the upper portion is required. Such a structure may increase the thickness of the induction module and result in a complex structure of the induction module.

Accordingly, when the outer lead wire extends to the lower portion of the base housing and is drawn out of the base housing, the base housing covers the outer lead wire. Thereby, the outer lead wire may be prevented from being displaced to the upper portion of the base housing. For this reason, it may be more preferable that the first penetrated portion for the outer lead wire is formed in the base housing.

In exemplary embodiments, the penetrated portion may include a second penetrated portion arranged inside the fixing rib.

In exemplary embodiments, the fixing rib may be arranged on a top surface of the base body, wherein the wire may pass through a space under the base body via the second penetrated portion and be drawn out to a rear side of the base body.

Herein, the second penetrated portion is provided to allow a lead wire (hereinafter referred to as an "inner lead wire") drawn out of the radially innermost side of the coil to pass therethrough. Of course, the inner lead wire may not extend to the lower portion of the base housing through the second penetrated portion. However, in this case, interference between the inner lead wire and the coil may not be avoided. Of course, in order to minimize the interference between the inner lead wire and the coil, the lead wire may be drawn out upward and then drawn out of the base housing.

However, in this case, since the inner lead wire does not closely contact the base housing, it is not easy to fix the inner lead wire. Accordingly, when the inner lead wire is extended to the lower portion of the base housing through the second penetrated portion and drawn out of the base housing, the base housing covers the outer lead wire. Accordingly, the inner lead wire may be prevented from being displaced to the upper portion of the base housing, and interference between the inner lead wire and the coil may be avoided.

In exemplary embodiments, the second penetrated portion may include a second inner wall defining a second through hole, and a second upper inclined surface connecting a top surface of the base body and an upper end of the second inner wall, and a second lower inclined surface connecting a lower end of the second inner wall and a bottom surface of the base body.

In exemplary embodiments, the laundry treatment apparatus may further include a wire holder provided on a top surface of the tub and disposed between the base housing and a rear end of the tub to connect the wire positioned behind the base body.

In exemplary embodiments, the wire holder may include an annular holder body, and a wire insertion portion fixed to an inner circumferential surface of the holder body and having a plurality of insertion slits allowing the wire to pass therethrough.

In the exemplary embodiments, the wire holder may further include a holder connection portion connecting the holder body and the top surface of the tub, the holder connection portion being formed of a flexible material so as to be bent according to movement of the wire.

In exemplary embodiments, the laundry treatment apparatus may further include a boss arranged at a rear end of the base body to limit a lateral movement range of the wire passing by a rear end of the base body.

In exemplary embodiments, the boss may include a first boss having a first wire accommodation groove for accommodating the wire drawn in from a rear side of the base body.

In exemplary embodiments, the boss may include a second boss having a second wire accommodation groove for accommodating the wire drawn out to the rear side of the base body.

In exemplary embodiments, the laundry treatment apparatus may further include a wire guider protruding from a bottom surface of the base body to fix, to the base body, the wire extending through the surface under the base body.

In exemplary embodiments, the fixing rib may protrude from the top surface of the base body to form a coil slot into which the wire is inserted, and the induction module may further include a permanent magnet disposed on the coil, a permanent magnet housing including a permanent magnet housing body covering the top surface of the base housing, and a permanent magnet mounting portion provided in the housing body to support the permanent magnet from below and closely contact an upper end of the fixing rib, and a cover coupled to an upper side of the permanent magnet housing.

In another aspect of the present invention, a laundry treatment apparatus includes a cabinet, a drum arranged in the cabinet and formed of a metal material to accommodate an object to be treated, and an induction module spaced apart from an outer circumferential surface of the drum by a predetermined distance to inductively heat the drum, wherein the induction module includes a coil formed by winding a wire, and a base housing including a base body and a fixing rib provided on the base body to fix the coil, wherein the wire is drawn into the base body in one direction, wound around the fixing rib, and drawn out of the base body in the same direction.

Wires extending from one end (start terminal) and an opposite end (end terminal) of the coil may be referred to as lead wires, and thus two lead wires are formed. The two lead wires extend from the radially outermost side of the coil and the radially innermost side of the coil to the outside of the induction module. The lead wires may be referred to as an outer lead wire and an inner lead wire, respectively.

The coil may be fixed to a top surface of the base housing, and the inner lead wire may vertically pass through the base housing and extend from the top surface to the bottom surface of the base housing.

The outer lead wire may also vertically pass through the base housing and extend from the top surface to the bottom surface of the base housing.

The coil may be laterally and longitudinally symmetrical. Since the outer circumferential surface of the drum is a curved surface, the coil and the base housing on which the coil is mounted may also be formed to have a curved surface corresponding to the outer circumferential surface of the drum.

For this reason, the inner lead wire may rectilinearly extend rearward from the lateral center position of the coil.

That is, the inner lead wire may substantially extend rearward along the longitudinal centerline of the base housing on the bottom surface of the base housing. Accordingly, the inner lead wire may be drawn out to the outside from the lateral center position on the rear side of the base housing.

The outer lead wire may be rectilinearly drawn rearward along the top surface or bottom surface of the base housing. However, the outer lead wire may be extended on the top surface or the bottom surface of the base housing to form a coil with a predetermined length, and then be drawn out of the base housing. Thereby, the area of the coil may be increased and the number of coil turns may also be substantially increased.

Here, a winding portion (coil forming section) of the outer lead wire functions to narrow the distance from the inner lead wire. Accordingly, the inner lead wire and the outer lead wire may be easily bound into a bundle and connected to the controller.

Of course, it is also possible to extend the outer lead wire to the drawing-out position of the inner lead wire. In this case, however, the distance between the outer lead wire and the controller may be further increased by the extended portion. This means an unnecessary increase in length of the lead wire.

Accordingly, when the inner lead wire is drawn out to the outside from the lateral center position of the base housing, the outer lead wire may be additionally extended only to a middle point between the left end of the base housing and the lateral center position of the base housing, and then be drawn to the outside. Of course, in this case, the controller may be located at the rear left side of the induction module.

The features in the above-described embodiments can be applied in combination in other embodiments unless they are contradictory or exclusive of each other.

To achieve the above object, in another aspect of the present invention, a laundry treatment apparatus includes a cabinet, a drum formed of a metal material to accommodate an object to be treated, and an induction module configured to inductively heat the drum.

The induction module includes a base housing having a coil slot formed in a top surface thereof to form a coil by inserting the wire into the coil slot.

The base housing includes two penetrated portions allowing two lead wires extending from both ends of the coil to extend from an upper portion of the base housing to a lower portion of the base housing therethrough so as to be drawn out of the base housing along a bottom surface of the base housing.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION

Hereinafter, the present invention will be described with reference to the drawings and examples specifically specifying the constituent elements and the like of the present invention. However, it should be noted that the drawings and the embodiments are merely used to provide further understanding of the present invention. Wherever possible, the same reference numbers will be used throughout the drawings to refer to the same or like parts.

In the following embodiments, certain elements may be shown or described exaggerated or reduced for convenience of description. This is also intended to provide further understanding the present invention.

Therefore, it will be understood by those skilled in the art that the present invention is not limited to the following embodiments, and various changes and modifications may be made without departing from the spirit and scope of the invention as defined by the appended claims.

Figure 1:
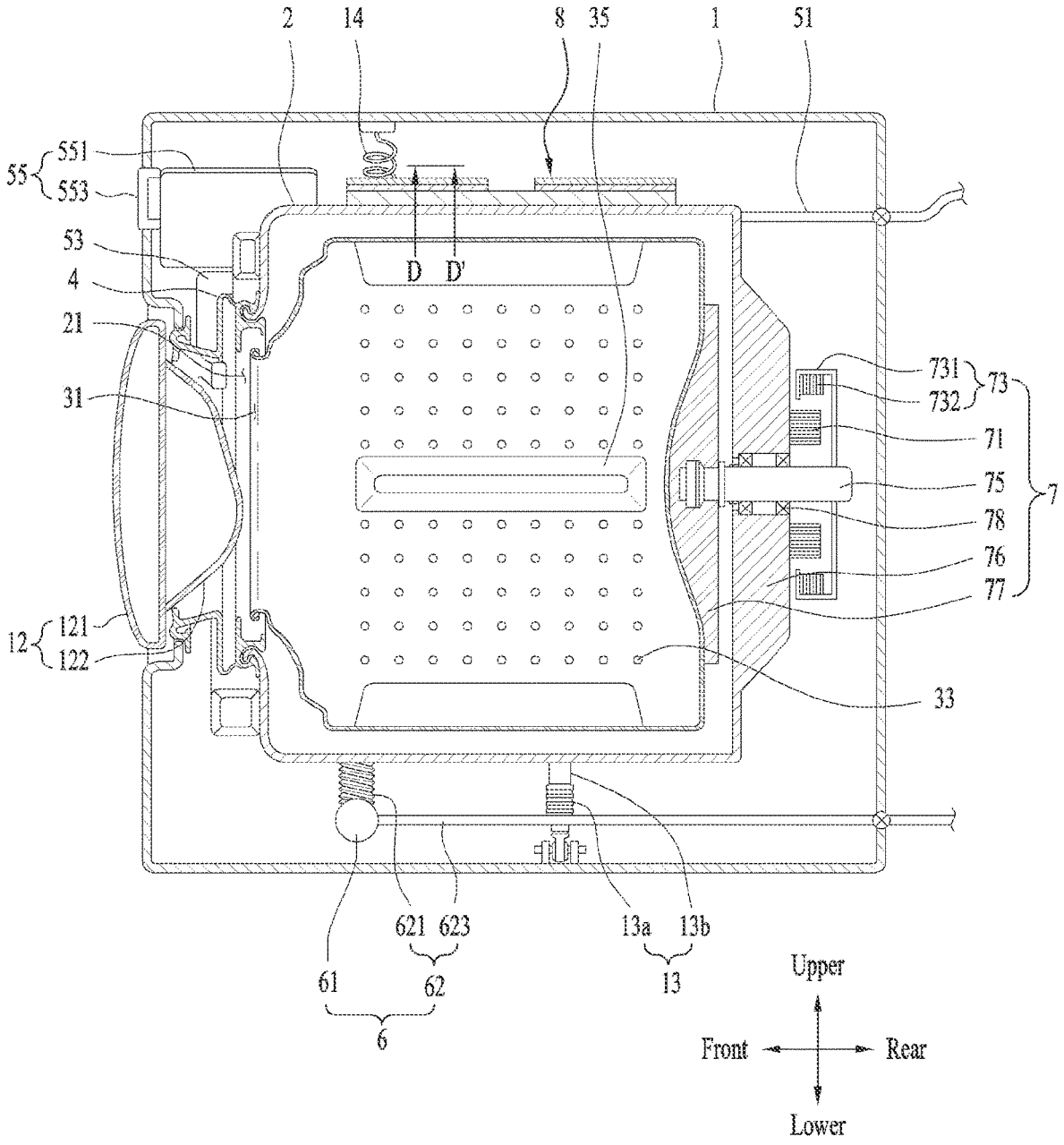
FIG. 1 is a sectional view showing the inside of a cabinet of the laundry treatment apparatus of the present invention.

First, with reference to FIG. 1 showing a cross-sectional view of a laundry treatment apparatus according to an embodiment of the present invention, the overall configuration of the laundry treatment apparatus will be described.

The laundry treatment apparatus according to the present invention may include a cabinet 1 defining an outer appearance, a tub 2 arranged in the cabinet 1, a drum 3 rotatably arranged in the tub 2 to accommodate laundry (or an object to be dried or object to be refreshed). The illustrated embodiment relates to a washing machine, in which washing water is stored in the tub 2 such that washing can be performed through the drum arranged in the tub. In the case of a dryer, such a tub may be omitted.

The cabinet 1 may include an introduction port arranged in the front of the cabinet 1. Laundry (or an object to be dried or object to be refreshed) is inserted or retrieved through the introduction port. A door 12 may be rotatably mounted on the cabinet 1 to open and close the introduction port.

The door 12 may include an annular door frame 121 and a viewing window 122 arranged at the center of the door frame.

Hereinafter, the direction toward the door 12 with respect to the center of the cabinet 1 may be defined as a front direction to help understand the detailed structure of the laundry treatment apparatus which is to be described below.

The direction opposite to the direction toward the door 12 may be defined as a rear direction, and the right and left directions may be naturally defined depending on the front and rear directions defined above.

The tub 2 is formed in a cylindrical shape to define a space in which water can be stored and is arranged such that a longitudinal axis thereof is parallel to the bottom surface of the cabinet 1 or maintained at 0 to 30° with respect to the bottom surface. A tub opening 21 is provided in the front of the tub 2 so as to communicate with the introduction port.

The tub 2 may be fixed to the bottom surface of the cabinet 1 by a support bar 13*a* and a lower support portion 13 including a damper 13*b* connected to the support bar 13*a*. Thereby, vibration generated in the tub 2 by rotation of the drum 3 may be attenuated.

In addition, an elastic support portion 14 fixed to the top surface of the cabinet 1 may be connected to a top surface of the tub 2. The elastic support portion 14 also serves to attenuate vibration generated in the tub 2 and transmitted to the cabinet 1.

The drum 3 is formed in a cylindrical shape to accommodate laundry (or an object to be dried or object to be refreshed) and is arranged such that a longitudinal axis thereof is parallel to the bottom surface of the cabinet 1 or maintained at 0 to 30° with respect to the bottom surface. A drum opening 31 communicating with the tub opening 21 may be provided in the front of the drum 3.

Accordingly, the user is allowed to insert laundry (or an object to be dried or object to be refreshed) into the inner space of the drum 3 through the introduction port, the tub opening 21, and the drum opening 31, or retrieve the laundry (or the object to be dried or object to be refreshed) from the inner space of the drum 3.

The drum 3 also includes a plurality of through holes 33 formed in the outer circumferential surface thereof in a penetrating manner. This is intended to allow the water stored in the tub 2 to be introduced into the drum and to allow the water discharged from the laundry (or the object to be dried or object to be refreshed) to be discharged into the inner space of the tub 2.

The drum 3 may further include a lifter 35 for stirring the laundry (or the object to be dried or the object to be refreshed) during rotation of the drum. The drum 3 may be rotated by a drive unit 7 arranged at the rear of the tub 2.

The drive unit 7 may include a stator 71 fixed to the back surface of the tub 2, a rotor 73 rotated by an electromagnetic operation with the stator 71, and a rotary shaft 75 arranged through the back surface of the drum 2 to connect the drum 73 and the rotor 73.

The stator 71 may be fixed to the rear surface of a bearing housing 76, which is arranged on the back surface of the tub 2, and the rotor 73 may include a rotor magnet 732 spaced apart from the stator 71 by a predetermined distance in a normal direction to the rotary shaft and a rotor housing 731 connecting the rotor magnet 732 and the rotary shaft 75.

Multiple bearings 78 for supporting the rotary shaft 75 may be arranged inside the bearing housing 76.

An arm 77 for facilitating transmission of rotational power of the rotor 73 to the drum 3 may be arranged on the back surface of the drum 3. The rotary shaft 75 configured to transmit the rotational power of the rotor 73 may be fixed to the arm 77.

The laundry treatment apparatus according to one embodiment may further include a water supply hose 51 for receiving water from the outside. The water supply hose 51 may be connected to a detergent supply unit 55.

Accordingly, the detergent may be diluted with water introduced through the water supply hose 51 and supplied to the tub 2 through a water supply pipe 53.

The detergent supply unit 55 may include a detergent box 551 fixed to an inner wall of the cabinet 10 and a detergent box drawer 553 detachably inserted into the detergent box 551 and allowed to be pulled out through the front of the cabinet 1.

A gasket 4 may be arranged between the introduction port of the cabinet 1 and the tub opening 21. The gasket 4 serves to prevent water in the tub 2 from leaking into the cabinet 1 and vibration of the tub 2 from being transmitted to the cabinet 1.

The gasket 4 may be configured to connect a portion of the cabinet 1 that forms the introduction port and a portion of the tub 2 that forms the tub opening 21, and may be formed of a flexible material such as rubber.

The laundry treatment apparatus according to one embodiment may further include a drainage unit 6 configured to discharge the water inside the tub 2 to the outside of the cabinet 1.

The drainage unit 6 may include a drain pipe 62 defining a drain passage through which water in the tub 2 moves, and a drain pump 61 configured to generate a pressure difference inside the drain pipe 62 such that water is drained through the drain pipe 62.

More specifically, the drain pipe 62 may include a first drain pipe 621 connecting the bottom surface of the tub 2 and the drain pump 61 and a second drain pipe 623 having one end connected to the drain pump 61 to form a flow passage through which water moves to the outside of the cabinet 1.

The laundry treatment apparatus according to one embodiment may include an induction module 8 configured to heat the drum for heating of washing water, drying of laundry (or an object to be dried or object to be refreshed), and refreshing (steam processing) of the laundry.

The induction module 8 may be applied to a laundry treatment apparatus having at least one function of washing, drying, and refreshing (steam processing). As described above, for a dryer that does not perform washing with water, the tub may be omitted. The tub may be replaced with a frame or bracket for mounting the induction module, which will be described later. Such a frame or bracket may be disposed spaced apart from the drum as in the case of the tub and configured to fix the induction module.

Figure 2:
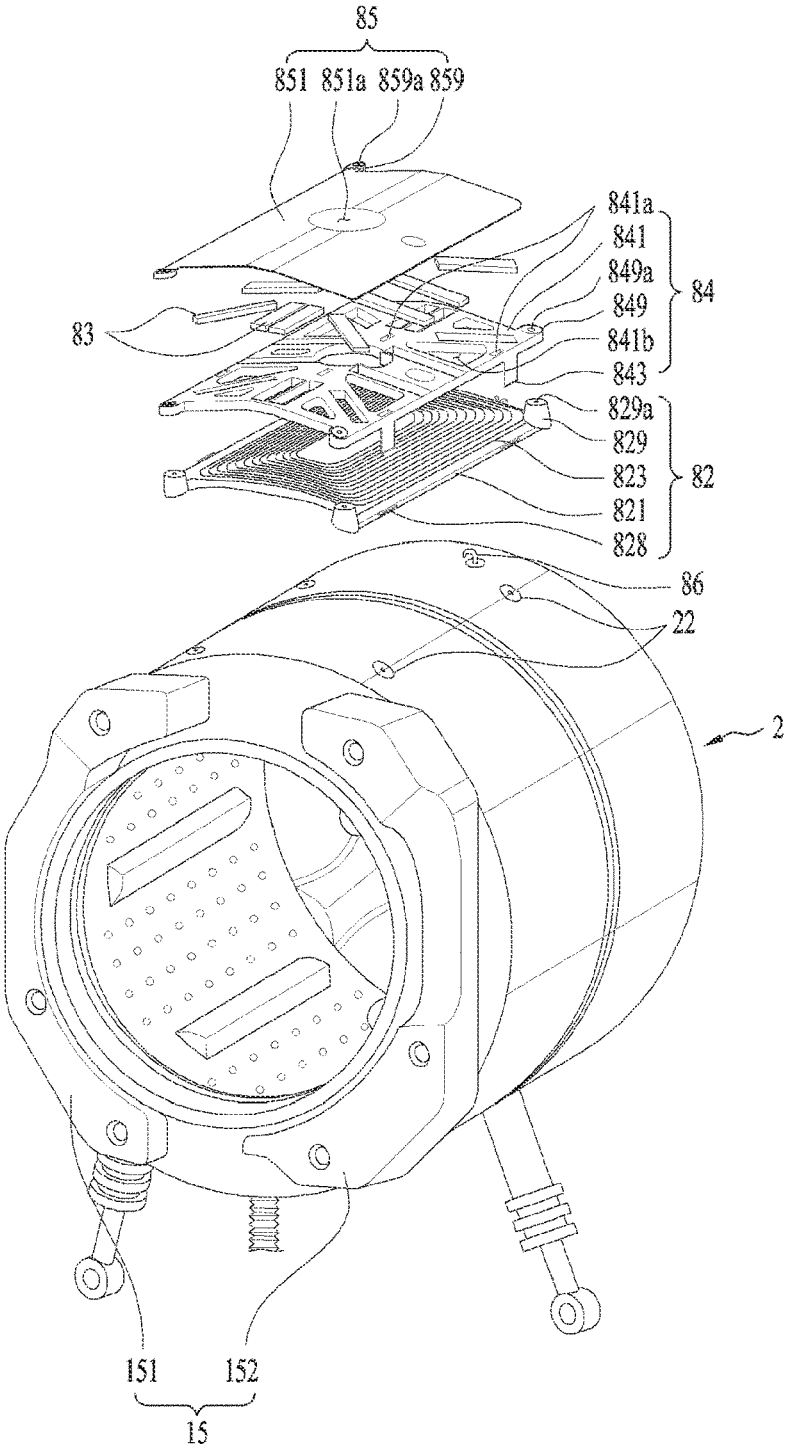
FIG. 2 is an exploded perspective view of an induction module and a tub of the laundry treatment apparatus of the present invention.

Hereinafter, the induction module 8 and a structure for mounting the induction module 8 on the laundry treatment apparatus will be described with reference to FIG. 2. For simplicity, the description will be made on the assumption that the laundry treatment apparatus is provided with a tub.

The induction module 8 is mounted on the circumferential surface of the tub 2. The induction module 8 heats the circumferential surface of the drum 3 through a magnetic field generated by applying electrical current to a coil 81 (see FIG. 3) formed by the windings of a wire 81*a*.

More specifically, when alternating current whose phase changes flows through the coil 81, the coil 81 forms a radial alternating current (AC) magnetic field according to Ampere's law. Then, when the AC magnetic field is concentrated at the drum 3 made of a conductor having high magnetic permeability, eddy currents are formed in the drum 3 according to Faraday's law of induction.

As a result, the eddy currents flowing through the drum 3 are converted into Joule heat by the resistance of the drum 3, thereby heating the inner wall of the drum 3 directly.

In order to securely fix the coil 81 to the top surface of the tub 2, the laundry treatment apparatus according to one embodiment may further include a base housing 82. The base housing 82 may be fixed to the circumferential surface of the tub 2 and arranged on the upper side of a horizontal plane passing through the rotary shaft 75 and parallel to the ground.

More specifically, the base housing 82 may have a rectangular plate shape or rectangular shape with a predetermined thickness. The base housing 82 may include a base body 821 having a front-to-rear length less than the front-to-rear length of the tub 2 and arranged on the upper side of the drum 3.

The base body 821 may be formed to have a curvature the same as or similar to that of the outer circumferential surface of the tub 2 or the drum 3 to concentrate the magnetic field generated in the coil 81 on the drum 3. Accordingly, the cross section of the base body 821 may include a curved shape. This magnetic field may be further concentrated through the curved cross section of the base body and the coil.

The base housing 82 may further include a fixing rib 823 protruding upward from the top surface of the base body 821 to wind the coil therearound. The fixing rib 823 may form a coil slot 822 into which the wire forming the coil is inserted (the structure of the fixing rib and the coil slot will be described in detail later).

The induction module 8 further may include a permanent magnet 83 arranged on the upper side of the base housing 82 to concentrate the magnetic field generated in the coil 81 toward the drum 3. The permanent magnet 83 may be a bar magnet.

A plurality of permanent magnets 83 may be arranged so as to be spaced apart from each other in the longitudinal direction of the coil 81. The permanent magnets 83 may be positioned on the coil 81 fixed to the base housing 82 and disposed perpendicular to the longitudinal direction of the wire forming the coil 81. This is intended to cover the inner coil and the outer coil at the same time.

The induction module 8 may further include a permanent magnet housing 84 coupled to the upper side of the base housing 82 to fix the permanent magnets 83 to the base housing 82.

The permanent magnet housing 84 may include a permanent magnet housing body 841 having a rectangular plate shape or rectangular shape with a predetermined thickness and corresponding to the base body 821, a plurality of permanent magnet mounting portions 842 provided to the permanent magnet housing body 841, and air flow holes 841*b* disposed between the permanent magnet mounting portions 842 and formed through the permanent magnet housing body 841 in a penetrating manner.

The permanent magnet mounting portions 842 may be arranged to allow the permanent magnets 83 to be inserted thereinto downward from the upper side and may be formed to support the lower portions of the permanent magnets 83.

The induction module 8 may further include a cover 85 coupled with the permanent magnet housing 84 to prevent the permanent magnets 83 from being separated upward from the permanent magnet mounting portions 842.

The cover 85 may include a cover body 851 having a rectangular plate shape or rectangular shape with a predetermined thickness, and an air discharge hole 851*a* provided at the center of the cover body 851 to allow heat (air) to be discharged by convection.

The permanent magnet housing 84 and the cover 85 are separated from each other in order to allow air to flow on the top surface of the permanent magnets 83 to accelerate cooling of the permanent magnets 83, to allow the permanent magnets 83 to be easily inserted and removed in changing the permanent magnets 83, and to prevent a part for fixing the permanent magnets 83 from having a closed surface such that injection is easily performed.

Hereinafter, a structure for fixing the base housing 82, the permanent magnet housing 84, and the cover 85 to the tub 2 will be described.

The base housing 82 may include a first fastening portion 829 formed at corners of the base body 821 and having a first fastening hole 829*a* through which a screw is inserted. The first fastening portions 829 may protrude from both sides of the front end and the rear end of the base body 821.

The tub 2 may be provided with a plurality of housing fixing portions 22 having a hollow communicating with the first fastening holes 829*a*.

The permanent magnet housing 84 may include a second fastening portion 849 formed at corners of the permanent magnet housing body 841 and having a second fastening hole 849*a* communicating with the first fastening hole 829*a* such that a screw is inserted therethrough. The second fastening portions 849 may protrude from both sides of the front end and the rear end of the permanent magnet housing body 841.

In addition, the cover 85 may include a third fastening portion 859 protruding from both sides of the front and rear ends of the cover body 851 and having a third fastening hole 859*a* communicating with the second fastening hole 849*a*.

Accordingly, one screw may be fixed to the housing fixing portion 22 through the third fastening hole 859*a*, the second fastening hole 849*a*, and the first fastening hole 829*a*.

The third fastening portion 859 may be arranged only on the left or right side of the front and rear ends of the cover body 851, and an insertion hook (not shown) to be inserted into a hook fastening hole 841*a* formed in the permanent magnet housing body 841 may be provided on the bottom surface of the cover body 851.

When the drum 3 rotates in the operation of washing, drying or refreshing, vibration may be transmitted to the tub 2, and the structures mounted on the tub 2 may be vibrated. Thereby, components mounted on the tub 2 may be damaged.

To address this issue, a weight balancer 15 for attenuating vibration generated by the drum may be arranged on the front surface of the tub 2 on the outer side of the gasket 4. The weight balancer 15 may include a first balancer 151 and a second balancer 152, which are arranged on both sides of the center of the width of the tub 2.

However, the weight balancers 15 can only attenuate vibration transmitted to the tub 2 and the tub 2 is still subjected to fine vibration. Accordingly, the coil 81 may be detached from the base housing 82 or may be disconnected due to friction resulting from contact between the coil 81 and the base housing 82.

Figure 3:
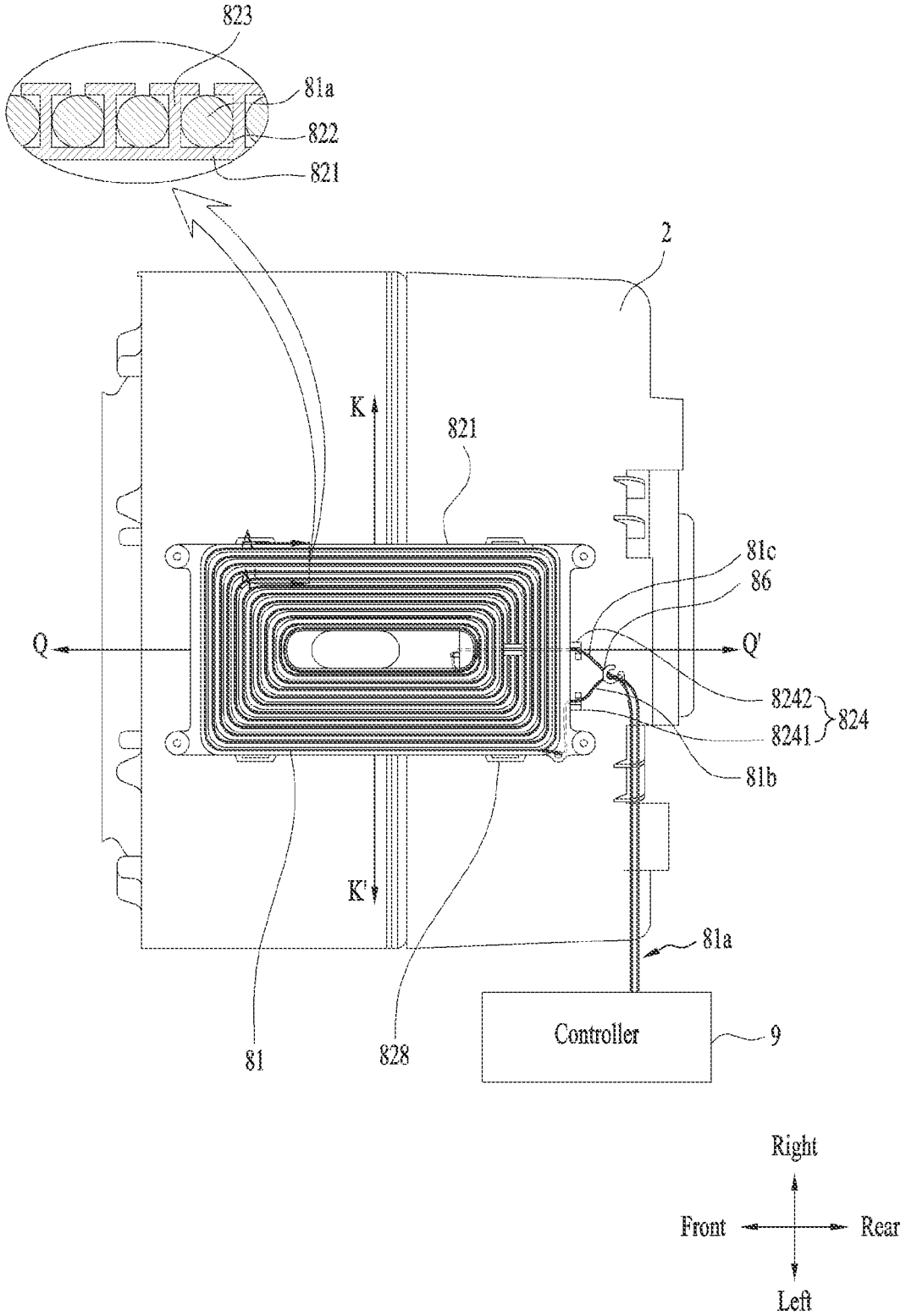
FIG. 3 is a top view of the tub on which the base housing of the induction module is mounted.

FIG. 3 shows the top surface of the base housing 82 around which the coil 81 is wound. Hereinafter, a structure for stably mounting the coil 81 on the base housing 82 will be described with reference to FIG. 3.

Here, the wire 81*a* extends from the outside of the base housing 82 to the base housing 82 to form the coil 81. A portion of the wire 81*a* extending to the outside of the base housing 82 for supplying electrical current to the coil 81 without forming the coil may be referred to as a lead wire. Two lead wires may be provided to supply current. The coil may be formed by winding a wire from the radially inner side to the outer side or vice versa. Accordingly, the lead wires may include an outer lead wire 81*b* extending from the radially outermost side of the coil 81 and an inner lead wire 81*c* extending from the radially innermost side of the coil 81.

The fixing rib 823 may form a coil slot 822 such that the coil 81 is formed by winding the wire 81*a* to a central portion from a position adjacent to the outermost side of the top surface of the base body 821. Accordingly, the space between the fixing ribs 823 may be referred to as the coil slot 822, and the coil may be formed by winding the coil by fixedly inserting the wire into the coil slot 822. That is, the coil slot 822 may be a wire fixing passage through which the wire can be wound inward from the radially outer side so as to be fixed.

Specifically, in a section taken along line A-A' in FIG. 3, the coil slot 822 may be formed to be narrower than the wire diameter of the wire 81*a* such that the wire 81*a* can be press-fitted.

The upper end of the fixing rib 823 may be melted to cover the upper portion of the wire 81*a* after the wire 81*a* is inserted. That is, the upper end of the fixing rib 823 may be bent to be parallel to the base body 821.

Both ends of the wire 81*a* constituting the coil 81 may be connected to a controller 9 configured to control the induction module 8 by regulating the supplied current. The controller 9 may be fixed to the cabinet 1.

A predetermined vibration phase difference is produced between the base housing 82 fixed to the tub 2 and the controller 9. In this case, the wire 81*a* may be disconnected or detached due to friction between the base housing 82 and the controller 9. In particular, vibration of the lead wires 81*b* and 81*c* outside the base housing 82 may be directly transmitted to the fixed coil 81, thereby detaching or damaging the wire constituting the coil 81.

The wire 81*a* may extend from the controller 9 to the base body 821 through the rear space of the base body 821 and then be wound around the fixing rib 823. Then, the wire 81*a* may be connected to the controller 9 through the rear space of the base body 821.

Particularly, when the controller 9 configured to control the current applied to the coil 81 is connected to the lead wires 81*b* and 81*c* at the rear of the induction module, the length of the lead wires may be minimized. This configuration may effectively reduce noise that may be generated by increase in length of the lead wires.

In addition, by connecting the wire 81*a* to the base housing through a point on the outer circumference of the tub 2 near the rear of the tub, which exhibits the smallest vibration displacement, the vibration phase difference formed along the wire 81*a* may be reduced, thereby preventing disconnection and detachment. This is because the vibration generated by the rotary shaft 75 of the drum 3 is transmitted to the rear wall of the tub 2 and thus the vibration displacement is larger at a position closer to the front of the tub 2.

Further, a wire holder 86 may be arranged behind the base body 821 to suppress vibration generated in the wire 81*a*. The wire holder 86 may be arranged between the controller 9 and the induction module 81 to primarily fix the lead wires 81*b* and 81*c*. For example, the wire holder 86 may be formed in a hook shape. The wire holder 86 may substantially bind the lead wires into a bundle and smoothly change the extension direction of the lead wires.

In addition, the lead wires may be allowed to be displaced within a certain range while being prevented from being separated from the wire holder 86. Thereby, a strong tensile force may be prevented from being applied to the lead wires.

The wire holder 86 may be arranged on the outer circumferential surface of the tub 2 to apply load to the wires 81*a* by holding the lead wires which are two strands of the wire 81*a*. Thereby, the wire holder 86 serves to reduce the vibration displacement at a position between the base housing 82 and the controller 9.

Figure 4:
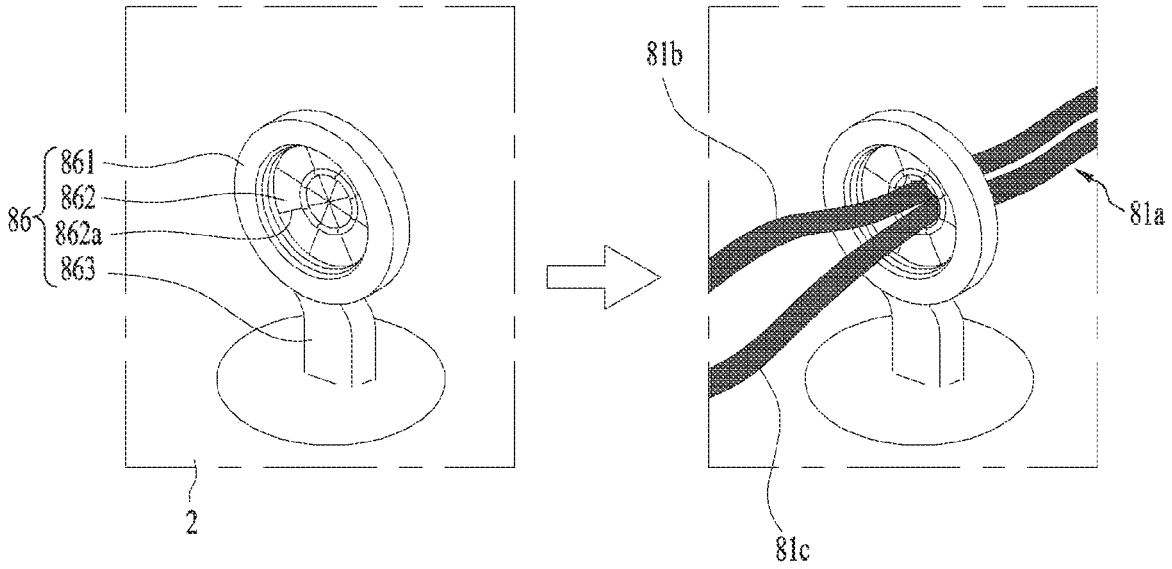
FIG. 4 is a perspective view of another embodiment of a coil holder.

Hereinafter, another embodiment of the wire holder 86 will be described with reference to FIG. 4.

The wire holder 86 may include an annular holder body 861, a wire insertion portion 862 connected to the inner circumferential surface of the holder body 861, and a plurality of wire insertion slits 862*a* radially formed with respect to the center of the wire insertion portion 862.

The wire insertion portion 862 may be formed of a flexible material which is bendable according to insertion of the wire 81*a*.

The wire holder 86 may further include a bar-shaped holder connection portion 863 arranged to connect the holder body 861 and the circumferential surface of the tub 2.

The wire holder 86 may be formed of a flexible material so as to be bent according to movement of the wire 81*a* to suppress the vibration.

Figure 5:
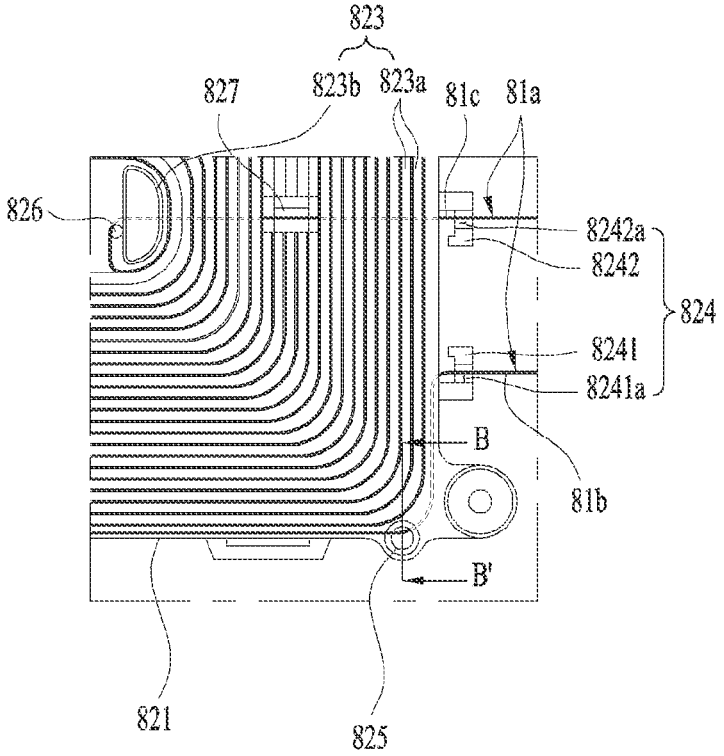
FIG. 5 shows a portion of the top surface of the base housing.
Figure 6:
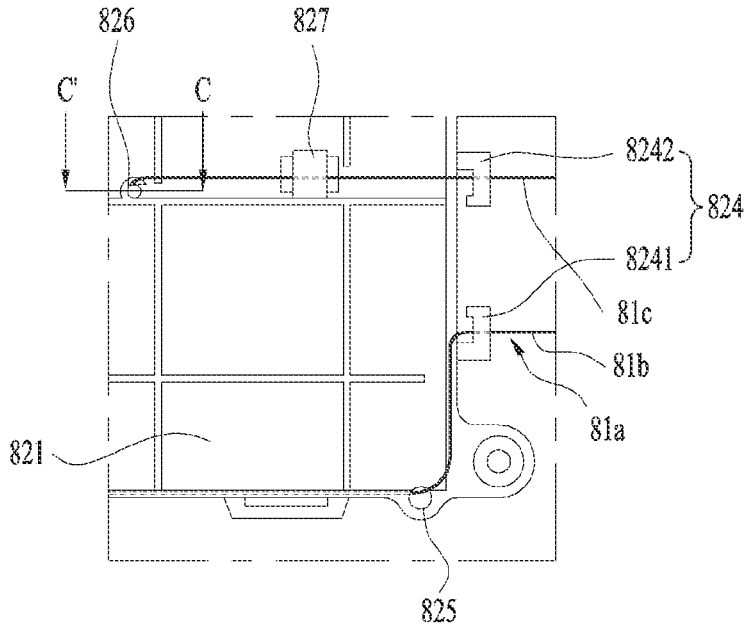
FIG. 6 shows a portion of the bottom surface of the base housing.

Hereinafter, a structure for fixing the wire 81*a* to the base housing 82 will be described in detail with reference to FIGS. 5 and 6. In particular, the structure for fixing a portion of the wire 81*a* drawn out from the coil formed by the wire 81*a* will be described in detail.

The fixing rib 823 may include an outer rib 823*a* formed such that the wire 81*a* is wound in a rectangular shape having rounded corners, and an inner rib 823*b* disposed inside the outer rib 823*a* and located behind the center of the base body 821 in the longitudinal direction Q-Q' (see FIG. 3).

The inner rib 823*b* may be formed in a semicircular shape with rounded corners and be arranged on a line perpendicularly to the width direction K-K' of the base body 821 (see FIG. 3) and parallel to the ground.

The wire 81*a* extending to the top surface of the base body 821 is sequentially wound around the outer rib 823*a* and the inner rib 823*b* and then extended to the rear space of the base housing body 821.

Here, the base body 821 may be provided with a first penetrated portion 825 and a second penetrated portion 826, which are formed by vertically penetrating the base body 821. The penetrated portions allow the wire 81*a* to extend through the lower space of the base body 821 to prevent the coil 81 from being separated.

More specifically, the first penetrated portion 825 may be formed in the base body 821 and be positioned between the outer rib 823*a* and a corner of the base body 821, and the second penetrated portion 826 may be positioned between the center of the base body 821 in the longitudinal direction Q-Q' (see FIG. 3) and the inner rib 823*b*.

Accordingly, the wire 81*a* extends by sequentially passing through the lower space of the base body 821, the first penetrated portion 825, the outer rib 823*a*, the inner rib 823*b*, the second penetrated portion 826, and the lower space of the base body 821.

A boss 824 may protrude from the rear end of the base body 821 to restrict a lateral movement range of the wire 81*a*. The boss 824 may include a first boss 8241 and a second boss 8242.

The first boss 8241 may be provided with a first wire accommodation groove 8241*a* formed to accommodate the outer lead wire 81*b*, which is the wire 81*a* extending from the rear space of the base body 821 to the lower space of the base body 821.

Similarly, the second boss 8242 may be provided with a second wire accommodation groove 8242*a* formed to accommodate the inner lead wire 81*c*, which is the wire 81*a* extending from the lower space of the base body 821 to the rear space of the base body 821.

Thus, the wire 81*a* may extend to the first penetrated portion 825 through the first boss 8241 and extend from the second penetrated portion 826 to the rear space of the base body 821 through the second boss 8242.

Figure 7:
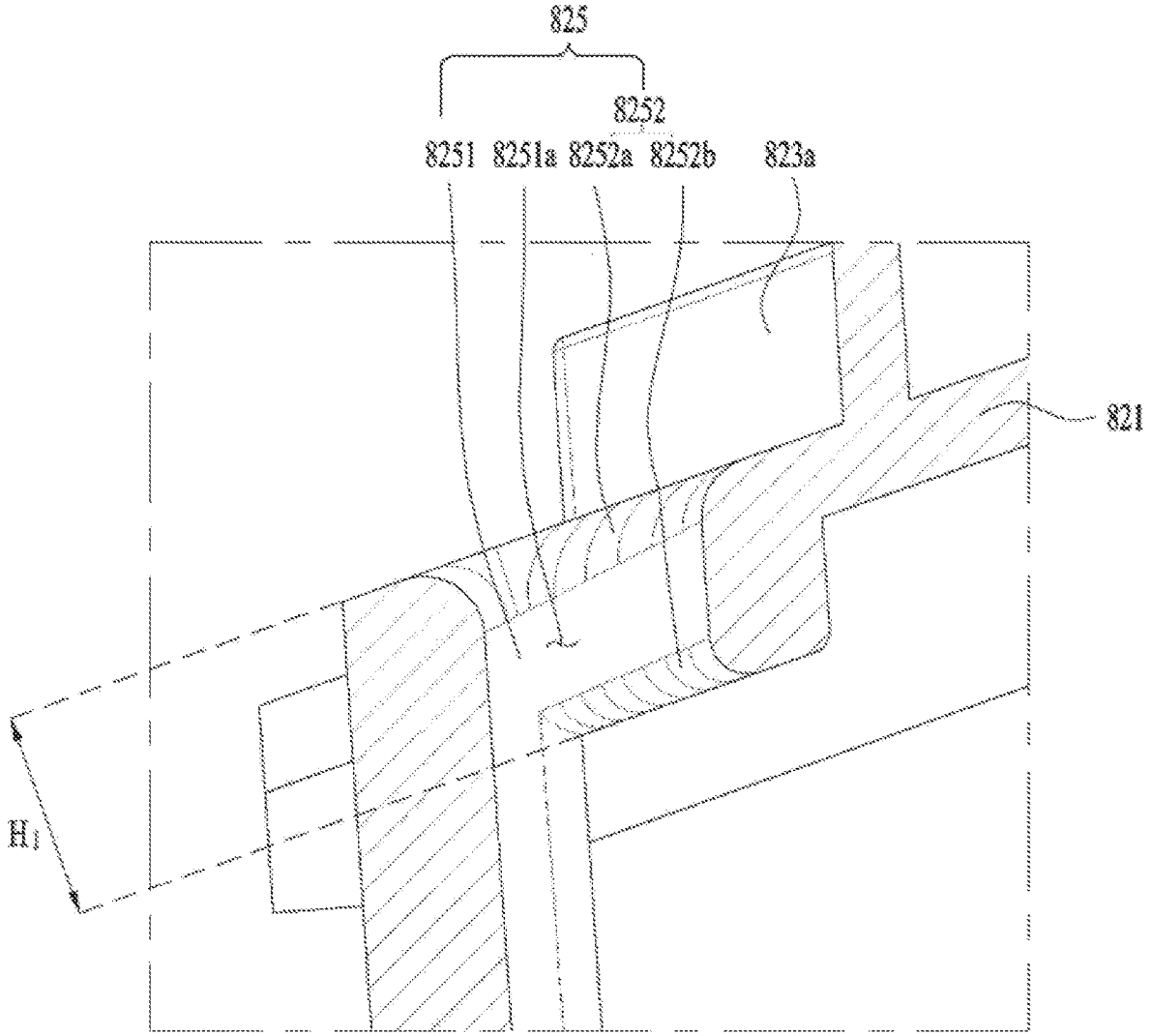
FIG. 7 is a cross-sectional view of a section taken along line B-B' of FIG. 5.

Hereinafter, the structure of the first penetrated portion 825 will be described in detail with reference to FIG. 7 showing a section taken along line B-B' of FIG. 7.

The first penetrated portion 825 may include a first inner wall 8251 defining a first through hole 8251*a* formed through the base body 821, and a first inclined surface 8252 connecting the first inner wall 8251 and the top and bottom surfaces of the base body 821.

Specifically, the first inclined surface 8252 may include a first lower inclined surface 8252*b* connecting the bottom surface of the base body 821 and the lower end of the first inner wall 8251, and a first upper inclined surface 8252*a* connecting the upper end of the first inner wall 8251 and the top surface of the base body 821.

Thus, the surface of the wire 81*a* passing through the first through hole 8251*a* is gently bent and bought into contact with the first inclined surface 8252, and accordingly vibration of the tub 2 may be prevented from damaging the wire 81*a*.

Further, the height H1 of the first through hole 8251*a* may be greater than or equal to 1.5 times the diameter of the wire 81*a*. This configuration may increase the curvature of the wire 81*a* passing through the first through hole 8251*a*, thereby preventing the wire 81*a* from being severely bent. Accordingly, damage to the wire and increase in resistance may be prevented.

Figure 8:
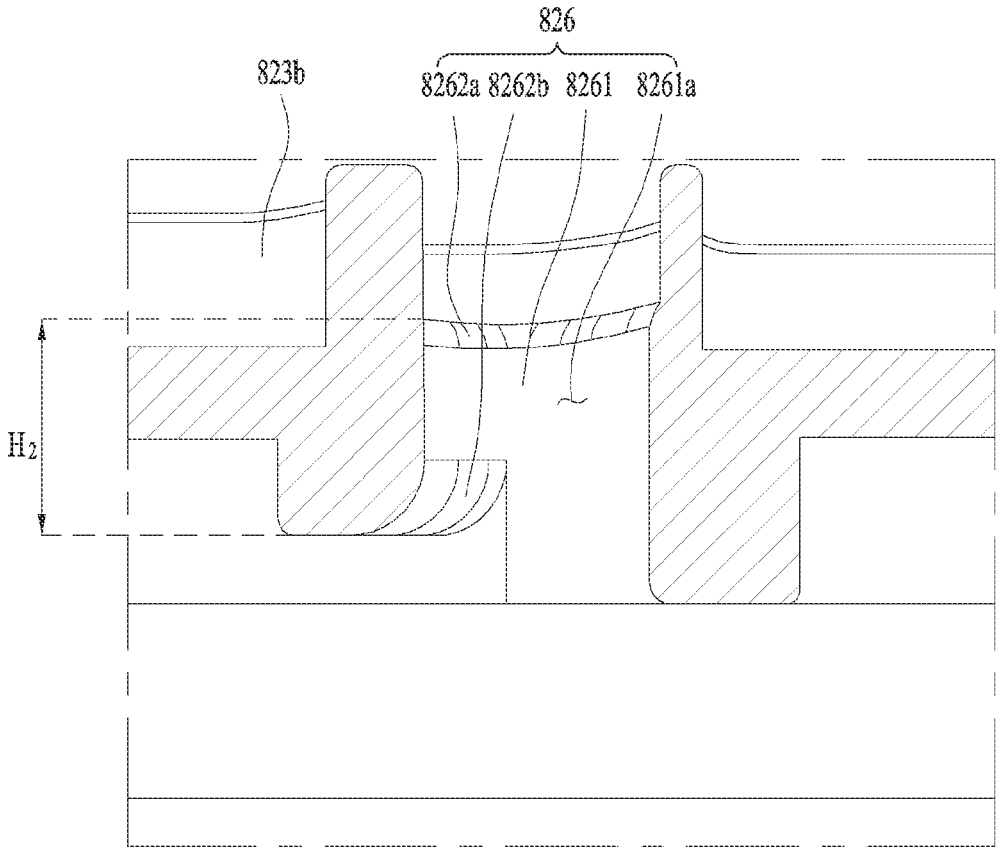
FIG. 8 is a cross-sectional view of a section taken along line C-C' of FIG. 6.

Hereinafter, the structure of the second penetrated portion 826 will be described in detail with reference to FIG. 8 showing a section taken along line C-C' of FIG. 6.

The second penetrated portion 826 may include a second inner wall 8261 defining a second through hole 8261*a* formed through the base body 821, and a second inclined surface 8262 connecting the second inner wall 8261 and the top and bottom surfaces of the base body 821.

Specifically, the second inclined surface 8262 may include a second upper inclined surface 8262*a* connecting the upper end of the second inner wall 8261 and the top surface of the base body 821, and a second lower inclined surface 8262*b* connecting the bottom surface of the base body 821 and the lower end of the second inner wall 8261.

The surface of the wire 81*a* passing through the second through hole 8261*a* is gently bent and bought into contact with the second inclined surface 8262, and accordingly vibration of the tub 2 may be prevented from damaging the wire 81*a*.

The height H2 of the second through hole 8261*a* may be greater than or equal to 1.5 times the diameter of the wire 81*a*. Accordingly, damage to the wire and increase in resistance may be prevented.

A wire guider 827 may be arranged between the second penetrated portion 826 and the second boss 8242. The wire guider 827 may securely fix the wire 81*a* to the bottom surface of the base body 821.

The wire guider 827 may protrude downward from the bottom surface of the base body 821 and support the wire 81*a* from the lower side.

Hereinafter, the shapes of the coil and the lead wires will be described in detail with reference to FIG. 5.

The wire is gently bent and diverted by the shape of the first penetrated portion 825 and the second penetrated portion 826. The wire may be bent approximately 90 degrees substantially through the first penetrated portion and the second penetrated portion.

The wire vertically passing through the second penetrated portion 826 extends rearward substantially along the longitudinal centerline of the base housing to form the inner lead wire 81*c*. Accordingly, interference between the coil and the inner lead wire may be prevented. Further, as shown in FIG. 5, the number of turns may be increased by drawing the wire through the second penetrated portion 826.

The wire vertically passing through the first penetrated portion 826 may extend on the bottom surface of the base housing so as to be parallel to the coil. That is, a portion of the outermost wire of the coil is formed. Accordingly, the area of the coil may be substantially increased through the outer lead wire 81*b*.

Here, by extending a part of the outer lead wire 81*b* to the lead portion of the inner lead wire 81*c*, the two lead wires may be easily bound into a bundle.

However, as shown in FIG. 3, when the controller 9 to which the lead wires are connected is on the left rear side of the induction module, the length of the outer lead wire 81*b* extending from the base housing may need to be limited. This is because increase in the extension length necessarily leads to increase in the length of the lead wires. That is, the length of the lead wire outside the base housing may be further increased.

Accordingly, the outer lead wires may extend only to a middle point between the first penetrated portion and the lateral center of the base housing in the base housing.

It can be seen that diversion of extension of the wire at the first penetrated portion and the second penetrated portion enables the wire to be fixed and minimizes the displacement and transmission of force through the wire.

The wires extending on the bottom surface of the base housing through the first and second penetrated portions may be fixed to the bottom surface of the base housing and may be fixed to the boss 824.

Accordingly, the induction module may be manufactured such that the wire is fixed to the boss 824 and drawn out. Then, in assembling the laundry treatment apparatus, the induction module may be mounted on the tub and the lead wires may be connected to the controller 9 after being fixed to the wire holder 86 arranged on the back of the tub.

Accordingly, it is easy to manufacture and handle the induction module. In addition, it is very easy to mount the induction module on the laundry treatment apparatus.

Figure 9:
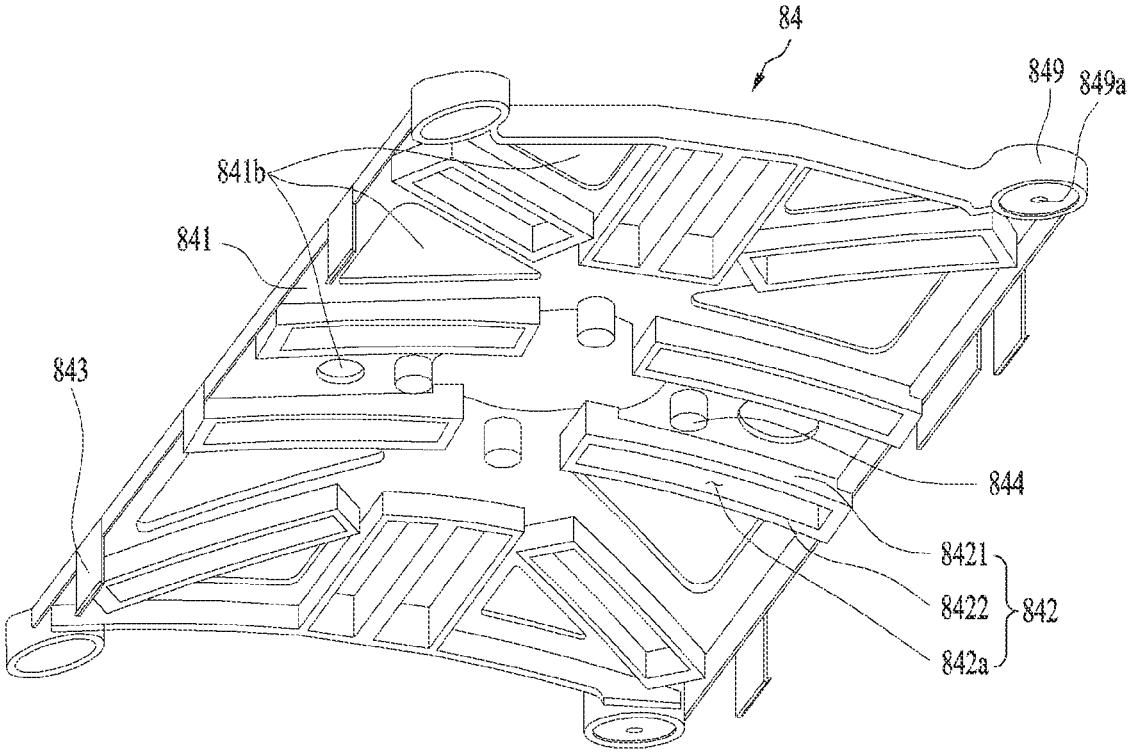
FIG. 9 is a perspective view of a permanent magnet housing.

Hereinafter, the permanent magnet housing 84 will be described with reference to FIG. 9.

The permanent magnet housing 84 may include a base housing fixing portion 843 protruding downward from left and right ends of the permanent magnet housing body 841.

The lower end of the base housing fixing portion 843 may be formed as a hook and inserted into an annular fixing portion accommodation loop 828 (see FIGS. 2 and 3) arranged at both ends of the base housing 82.

Further, a plurality of reinforcing projections 844 protruding downward may be arranged on the bottom surface of the permanent magnet housing body 841. The reinforcing projections 844 may be formed to closely contact the upper ends of the fixing ribs 823.

Accordingly, the permanent magnet housing 84 may be more securely fixed to the top surface of the base housing 82.

The permanent magnet housing 84 may further include a permanent magnet mounting portion 842 formed on the permanent magnet housing body 841 to accommodate the permanent magnet 83.

The permanent magnet mounting portion 842 may include a mounting portion sidewall 8421 extending downward from the permanent magnet housing body 841, and a lower rib 8422 projecting from the mounting portion sidewall 8421 to be parallel to the permanent magnet housing body 841 and support the bottom surface of the permanent magnet 83.

In addition, the lower rib 8422 is provided with an open hole 842*a* such that a part of the bottom surface of the permanent magnet 83 is open to the lower side.

Figure 10:
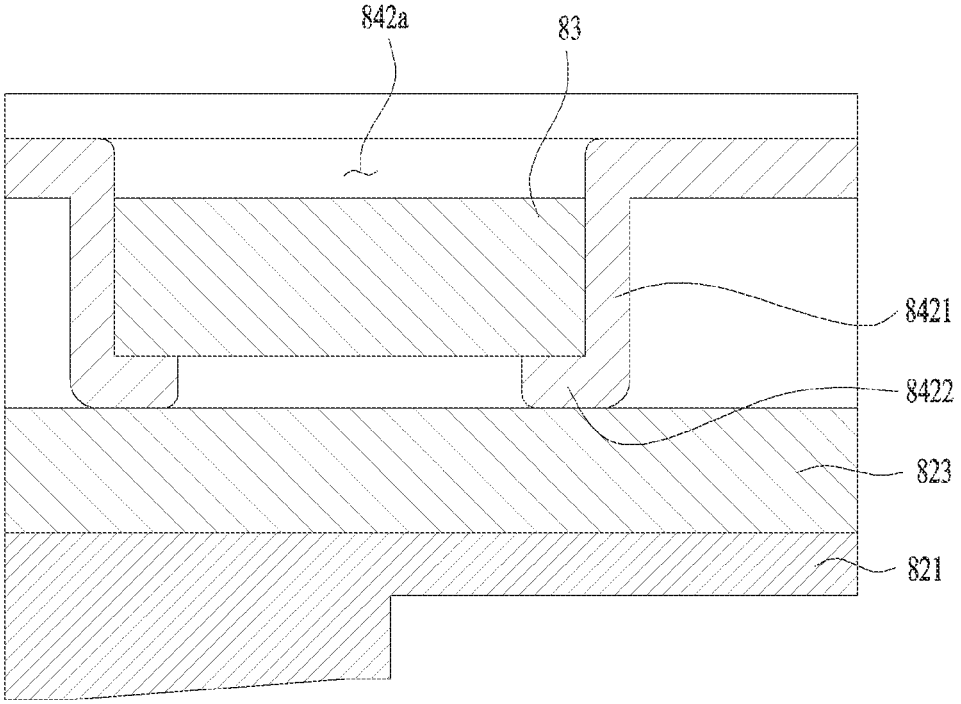
FIG. 10 is a cross-sectional view of a section taken along line D-D' of FIG. 1.

Hereinafter, the arrangement relationship between the lower rib 8422 and the fixing rib 823 will be described with reference to FIG. 10 showing a section taken along line D-D' in FIG. 1.

The bottom surface of the lower rib 8422 may be arranged to closely contact the upper end of the fixing rib 823 to improve the fastening and stably heat the drum 3.

In this case, the coil 81 may be prevented from being separated from the base housing 82, and the bottom surface of the permanent magnet 83 may be closer to the coil 81, thereby further concentrating the magnetic field toward the drum 3. Further, the lower rib 8422 may strengthen the close contact between the permanent magnet housing 84 and the base housing 82.

As apparent from the above description, a laundry treatment apparatus according to the present invention has effects as follows.

First, a coil for induction heating may be securely fixed. In particular, even when an induction module is fixed to an element such as a vibrating tub, the coil provided in the induction module may be securely fixed.

Second, damage to a coil and lead wire for induction heating may be prevented. Particularly, interference between the lead wire and the coil may be avoided, and the lead wire may be securely fixed to the induction module so as to be extended to the outside. More specifically, when the induction module is mounted on a vibrating tub, the lead wire may be connected to a controller by being fixed through a portion of the outer circumferential surface that vibrates least. Thereby, vibration applied to the lead wire may be effectively reduced.

Third, the length of a wire forming a coil for induction heating may be minimized.

Fourth, two lead wires are vertically arranged through the base housing of the induction module so as to be drawn out of the base housing while being in close contact with the bottom surface of the base housing. Accordingly, even when a portion of the lead wires outside the induction module vibrates, transmission of vibration and force to a portion of the lead wires inside the induction module may be effectively suppressed or eliminated.

The present invention may have other effects in addition to the effects of the respective constituents described above, and new effects which are be expected in the prior art may be derived according to the coupling relationship between the above-described constituents.

It will be apparent to those skilled in the art that various modifications and variations can be made in the present invention without departing from the spirit and scope of the invention. Thus, it is intended that the present invention cover the modifications and variations of this invention provided they come within the scope of the appended claims and their equivalents.

What is claimed is:

1. A laundry treatment apparatus comprising:
- a cabinet;
- a tub disposed in the cabinet;
- a drum made of a metal material and disposed in the tub;
- a driver disposed at a rear portion of the tub and configured to rotate the drum; and
- an induction module configured to heat the drum by induction,
- wherein the induction module comprises:
  - a base housing comprising (i) a base body that is fixed to a circumferential surface of the tub and (ii) a fixing rib that protrudes from the base body, and
  - a wire comprising (i) a coil wound around the fixing rib and (ii) a lead wire extending from the coil along the base body and drawn out of the base body through a rear side of the base body adjacent to the rear portion of the tub.

2. The laundry treatment apparatus of claim 1, wherein the lead wire comprises:
- an outer lead wire that extends from one end of the coil, the one end of the coil positioned at an outermost side of the coil; and
- an inner lead wire that extends from the other end of the coil, the other end of the coil positioned at an innermost side of the coil.

3. The laundry treatment apparatus of claim 2, wherein the base housing defines a first penetrated portion that receives the outer lead wire, the outer lead wire passing through the first penetrated portion and then extending along the base housing.

4. The laundry treatment apparatus of claim 3, wherein the base housing further defines a second penetrated portion that receives the inner lead wire, the inner lead wire passing through the second penetrated portion and then extending along the base housing.

5. The laundry treatment apparatus of claim 4, wherein the inner lead wire extends toward the rear portion of the tub along a longitudinal centerline of the coil.

6. The laundry treatment apparatus of claim 3, wherein the first one end of the coil is positioned adjacent to the first penetrated portion.

7. The laundry treatment apparatus of claim 4, wherein the other end of the coil is positioned adjacent to the second penetrated portion.

8. The laundry treatment apparatus of claim 3, wherein the one end and the other end of the coil are spaced apart from each other in a circumferential direction of the tub, and
- wherein the outer lead wire comprises:
  - a first outer portion that extends from the one end of the coil and passes through the first penetrated portion;

a second outer portion that is bent from the first outer portion at the rear side of the base body and then extends along the circumferential direction of the tub; and a third outer portion that is bent from the second outer portion and then extends from the second outer portion toward the rear portion of the tub.

9. The laundry treatment apparatus of claim 1, further comprising a current supply that is fixed to an inside of the cabinet and connected to the lead wire, the current supply being disposed at a rear side of the cabinet.

10. The laundry treatment apparatus of claim 4, wherein the first penetrated portion is defined at the outermost side of the coil, and the second penetrated portion is defined at the innermost side of the coil.

11. The laundry treatment apparatus of claim 10, wherein the first penetrated portion is positioned at the rear side of the base body facing the rear portion of the tub.

12. The laundry treatment apparatus of claim 10, wherein the second penetrated portion is positioned at the rear side of the base body facing the rear portion of the tub.

13. The laundry treatment apparatus of claim 10, wherein each of the first and second penetrated portions comprises:

an inner wall that defines a through-hole that receives the lead wire;

a lower inclined surface that connects a bottom surface of the base body to a lower end of the inner wall, the lower inclined surface being inclined with respect to the bottom surface of the base body; and an upper inclined surface that connects an upper end of the inner wall to a top surface of the base body, the upper inclined surface being inclined with respect to the top surface of the base body.

14. The laundry treatment apparatus of claim 1, further comprising:

a wire holder disposed at the circumferential surface of the tub and positioned at a rear of the base body.

15. The laundry treatment apparatus of claim 14, wherein the wire holder comprises:

a holder body having an annular shape;

a wire insertion portion that is fixed to an inner circumferential surface of the holder body and defines a plurality of insertion slits receiving the wire; and a holder connection portion that connects the holder body to the circumferential surface of the tub, the holder connection portion being made of a flexible material and configured to bend according to movement of the wire.

16. The laundry treatment apparatus of claim 4, further comprising:

a boss disposed at the rear side of the base body and configured to limit a lateral movement of the lead wire, wherein the boss comprises:

a first boss that defines a first wire accommodation groove that accommodates a portion of the outer lead wire that extends rearward from the rear side of the base body; and a second boss that defines a second wire accommodation groove that accommodates a portion of the inner lead wire that extends rearward from the rear side of the base body.

17. The laundry treatment apparatus of claim 16, wherein the base housing further comprises a wire guider that protrudes from a bottom surface of the base body, the wire guider being configured to fix, to the base body, at least a portion of the lead wire extending along the bottom surface of the base body.

18. The laundry treatment apparatus of claim 13, wherein a height of each of the first and second penetrated portions is greater than a diameter of the wire.

19. The laundry treatment apparatus of claim 16, wherein the second boss is located at a longitudinal centerline of the coil, and the first boss is arranged between the first penetrated portion and the second boss.

20. The laundry treatment apparatus of claim 19, wherein the wire extends from the first penetrated portion to the first boss along a bottom surface of the base body.

21. The laundry treatment apparatus of claim 1, wherein the fixing rib comprises a plurality of ribs that are curved along a rectangular shape, the plurality of ribs having rounded corners and straight portions, and wherein the rounded corners have a semicircular shape, and circumferential lengths of the rounded corners are equal to one another.

* * * * *